United States Patent [19]

Yuter

[11] 4,184,050

[45] Jan. 15, 1980

[54] DRINK SERVICE SYSTEM

[76] Inventor: Seymour C. Yuter, 407 Cedar Dr. West, Briarcliff Manor, N.Y. 10510

[21] Appl. No.: 856,253

[22] Filed: Dec. 1, 1977

Related U.S. Application Data

[62] Division of Ser. No. 703,952, Jul. 9, 1976, Pat. No. 4,074,793.

[51] Int. Cl.[2] ..... H04R 27/00

[52] U.S. Cl. ..... 179/1 GA; 179/1 AT

[58] Field of Search ..... 179/1 R, 1 A, 1 AT, 179/1 G, 1 GA, 1 DM; 52/238, 239, 27, 28, 171, 144; 186/1; 181/289

[56] References Cited

U.S. PATENT DOCUMENTS

| | | | |
|---|---|---|---|
| 3,045,064 | 7/1962 | Sellers | 179/1 AT |
| 3,264,410 | 8/1966 | Schoenbaum | 179/1 R |
| 3,266,204 | 8/1966 | Andrews | 52/239 |
| 4,019,295 | 4/1977 | Derner et al. | 181/289 |

*Primary Examiner*—Gerald Brigance

*Attorney, Agent, or Firm*—S. C. Yuter

[57] ABSTRACT

The drink service system disclosed in the specification comprises dining and bar areas, a cocktail lounge, a kitchen and an order-taking post separate from and adjacent the dining and bar areas to facilitate the direct delivery of food and drink orders taken by telephone from patrons in the dining area and cocktail lounge in visual communication with the order-taking person (FIGS. 1–4). A combined piano bar-bandstand straddles the bar area and dance floor (FIG. 1). Variably-translucent panels control visual communication with the dining area (FIGS. 1, 8). Each table has its own speaker and volume control for music playing (FIG. 5). Detachable carpet panels permit the movement of telephone and audio cables coupled to the tables (FIG. 6). A phone protection system signals the cutting of any telephone cable (FIG. 7). The bar area is glass-enclosed to control the sound and smoke levels, and a microphone within the bar area permits the feeding of the bar area sound at a controlled audio level into the audio amplifier system feeding the table speakers.

3 Claims, 12 Drawing Figures

FIG. 5
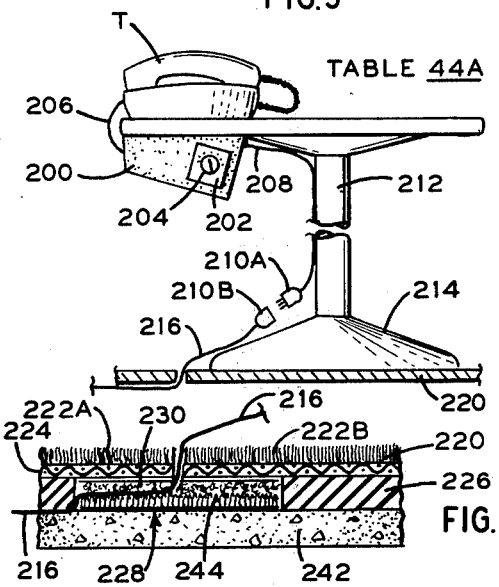
FIG. 6A
FIG. 6B
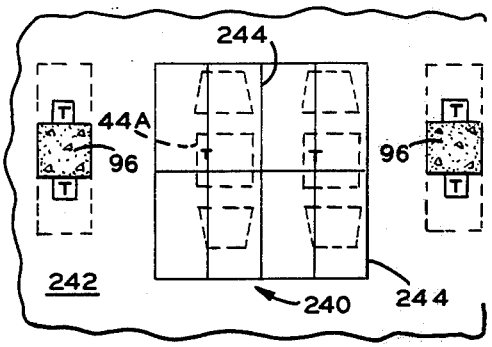
FIG. 7A
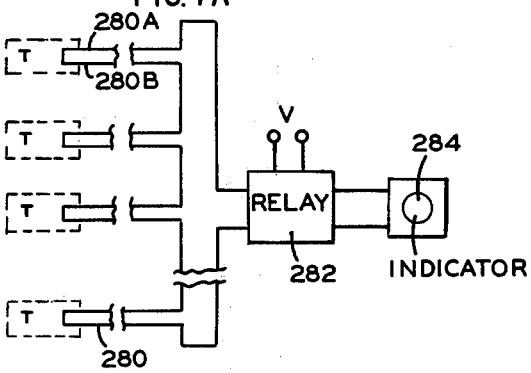
FIG. 7B
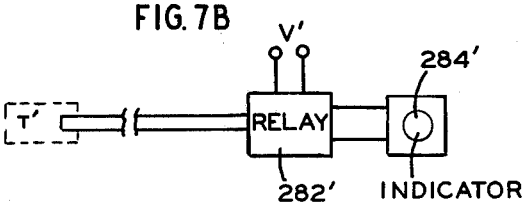
FIG. 8
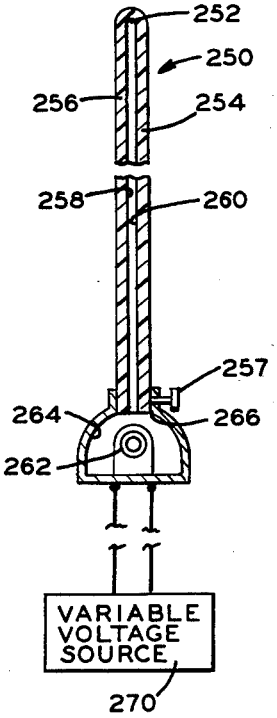

DRINK SERVICE SYSTEM

This is a division of application Ser. No. 703,952 filed July 9, 1976, now U.S. Pat. No. 4,074,793 issued Feb. 21, 1978 (the "'793 patent").

This invention relates to a drink service system and, more particularly, to an improved system for controlling noise and smoke transmitted between a bar area and an adjacent cocktail lounge or dining room.

A comfortable drink service system is the principal object of the invention.

A feature of the '793 patent is the provision of a music-playing loud speaker mounted at each table in the cocktail lounge and dining room. With an associated volume control it permits playing recorded or live music throughout the restaurant at an audio level which facilitates conversation at ordinary voice levels.

In accordance with the preferred embodiment of the invention, a drink service system is provided comprising a bar area, an adjacent cocktail lounge or dining area and a transparent partition substantially enclosing the bar area and separating the bar area from the adjacent area to lower the noise and smoke transmitted to the adjacent area, especially during busy periods of time. During lull periods, a microphone within the enclosed bar area picks up background noise which is fed at a controlled level via an audio amplifier to speakers at tables in the adjacent area to make the area sound more busy.

Other objects, features and advantages of the drink service system will be obvious from the following detailed description taken together with the accompanying drawings in which:

FIG. 5 is a side elevational view of a table for two, partly broken away, in the center of the cocktail lounge, and showing a telephone, a loud speaker mounted beneath the table and the cable plug, with the flat cable passing between edges of carpet panels attached to the floor.

FIG. 6A is an enlarged cross-sectional view of the carpet panel edge construction with the Velcro-type fasteners, and showing the flat cable passing from beneath the carpet.

FIG. 6B is a plan view of a portion of the rectangular grid Velcro-type fasteners attached to the floor, but with the carpet panels removed, and showing tables and chairs in dotted outline.

FIG. 7A is an electrical circuit diagram of the telephone protection circuit for indicating when a phone cable is cut.

FIG. 7B is an electrical circuit diagram of a portion of an alternative embodiment of a phone protection circuit with a separate indicator for each phone.

FIG. 8 is a cross-sectional view of a variably-translucent partition separating the dining area from the cocktail lounge.

DINING SYSTEM (FIG. 1)

Figure 1:
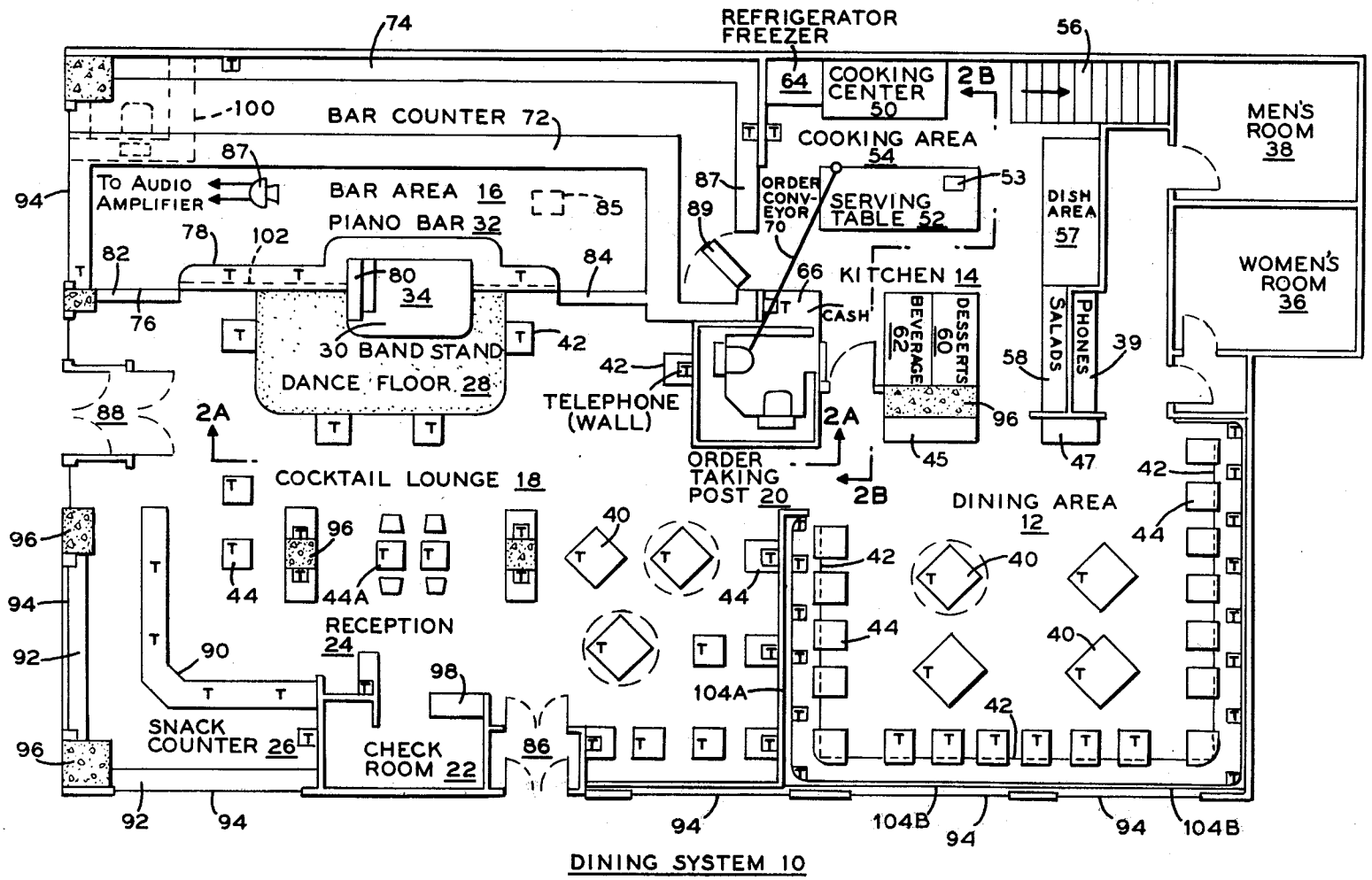
FIG. 1 is a floor plan of the preferred embodiment of the drink service invention showing the transparent partition, which separates the bar area and the adjacent cocktail lounge, as dotted line 102 together with the dining area, kitchen and order-taking post.

FIG. 1 (FIG. 1) discloses the general arrangement of the dining system in accordance with a preferred embodiment of the '793 patent invention. Dining system 10 generally comprises the dining area 12, kitchen 14, bar area 16, cocktail lounge 18 and the order-taking post 20. Also included are the check room 22, reception 24, snack counter 26, dance floor 28, bandstand 30 and piano bar 32. The combined music bar-bandstand is designated as 34. Women's room 36, men's room 38 and pay phones 39 complete the general arrangement.

Dining area 12 includes the larger tables 40 and the banquette 42 with smaller tables 44. The "T"s designate telephones on the tables. Enclosed "T"s designate wall-mounted phones. Service stations 45 and 47 facilitate food service by serving personnel.

Kitchen 14 generally comprises a cooking center 50 which, together with serving table 52, makes up the cooking area 54 for short-order dishes. Foods that can be cooked in advance are prepared in a lower kitchen (not shown but which is accessed by stairs 56) and transferred to a steam table facility on serving table 52. Serving table 52 includes a sink 53. Also downstairs are the remaining facilities of a restaurant including lockers, rest rooms for staff, storage, freezers, refrigerators and supporting electrical and air conditioning equipment. In particular the dish washing and pot cleaning equipment is downstairs but a dish area 57 upstairs, adjacent the stairs, is used as a drop for dirty dishes and pots and for the storage of clean dishes and pots. Additional areas include the salad area 58, dessert area 60 and beverage area 62; also a refrigerator-freezer 64 to service the cooking area 54. A table 65 is also provided for a cashier, later discussed in greater detail.

Finally, the most novel feature of the kitchen 14 is the order conveyor 70 which conveys written orders from the order-taking post 20 to the cooking area 54. The order conveyor 70 will be explained in detail later in connection with FIGS. 2–4.

Bar area 16 generally comprises the bar counter 72, the liquor shelf 74, floor 76 and telephone counter 78. Telephone counter 78 becomes the counter for the piano bar 32 which partially encloses the bandstand 30 which supports the piano or organ 80. The bar floor 76 is raised about one foot from the restaurant floor and especially the dance floor 28. Steps 82 and 84 provide access to the bar area 16. The bandstand 30 extends into the area of the dance floor 28. The difference in levels is later described in connection with FIG. 2A.

Access between the bar area 16 and kitchen 14 is via a serving pass-through 87 which includes the dutch door 89 for transferring liquor, beer barrels, ice, etc., from storage downstairs and refuse to downstairs.

Cocktail lounge 18 generally comprises the larger tables 40 and smaller tables 44. The smaller tables 44 usually seat two and the larger four. Those within a dotted circle are expandable to seat six or more.

Entry to and exit from the restaurant are via doors 86 and 88.

The snack counter 26 generally comprises a service counter 90 and food storage and display counters 92. The food is displayed to passersby via the store windows 94. The snack counter 26 preferably serves mostly cold foods together with cold and hot beverages. Columns 96 are part of the supporting building structure.

The check room 26 includes the coat counter 98.

Shown in dotted outline in the upper lefthand corner of FIG. 1 is an order-taking post 100 in accordance with another embodiment of the system in which the floor of the order-taking post 100 is substantially higher than the level of the bar floor 76. Thus, order-taking persons can see over the heads of patrons at the bar to take drink orders from patrons in the cocktail lounge 18; especially when the dance floor 28 is occupied with tables; for example, during lunch. In that case, order-taking post 20 would concentrate more on food orders, particularly at the beginning of the lunch period.

The dotted line 102 along the telephone counter 78 represents a transparent partition, for example, a glass window, which encloses most of the bar area 16 except for the stairs 82 and 84, in accordance with the preferred embodiment of the present invention. Enclosing the bar area 16 serves two purposes. It permits the more efficient use of a smoke exhaust system 85 (shown in dotted outline) mounted in the ceiling over the bar, where the cigarett and cigar smoke is most concentrated. It also lowers the noise transmitted from the bar to the rest of the restaurant. In that case, a microphone 87 hanging from the ceiling by suitable means (not shown) may be used to pick up background noise and feed it at controlled audio levels into the electronic audio amplifier system feeding the loud speakers throughout the restaurant. The audio amplifier system is preferably located at the order-taking post 20. An advantage of that feature is to make the restaurant sound more busy during lull hours.

The loudspeakers are mounted beneath the tables and contain their own volume controls so that the music and noise level may be kept low to permit conversation and normal voice levels. The loudspeakers are described in greater detail in connection with FIG. 5.

In between dining hours, when the cocktail lounge and the bar may be busy, it is desirable to block the empty dining area from view. That is accomplished by a variably translucent partition 104 vertically mounted along the outer edge of the portion of the banquette 42 adjacent the cocktail lounge 18 and reaching a height above eye level. The variably-translucent partitions 104 are also useful to block inside areas from outside viewing, for example, through the window 94 in the dining area 12. The variably-translucent partitions 104 are described in greater detail in connection with FIG. 8.

ORDER-TAKING SYSTEM (FIGS. 1, 2–4)

Figure 2A:
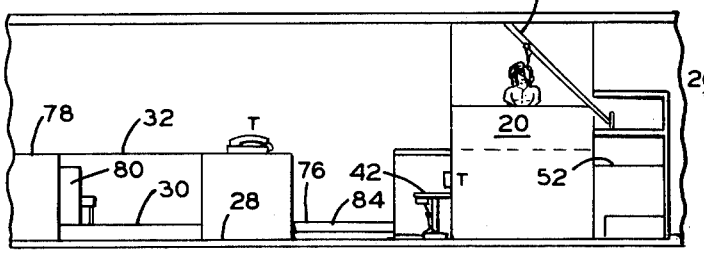
FIG. 2A is a front elevational view, taken along the lines 2A—2A of FIG. 1, of the order-taking post and a portion of the adjacent bar area.
Figure 2B:
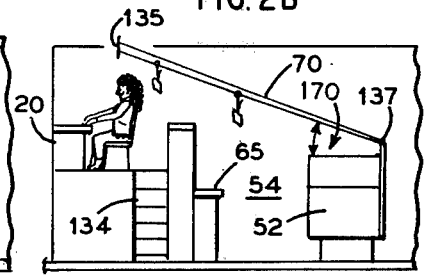
FIG. 2B is a side elevational view, taken along the lines 2B—2B of FIG. 1, of the order-taking post and showing a wire order conveyor carrying orders to the cooking area of the kitchen.
Figure 3:
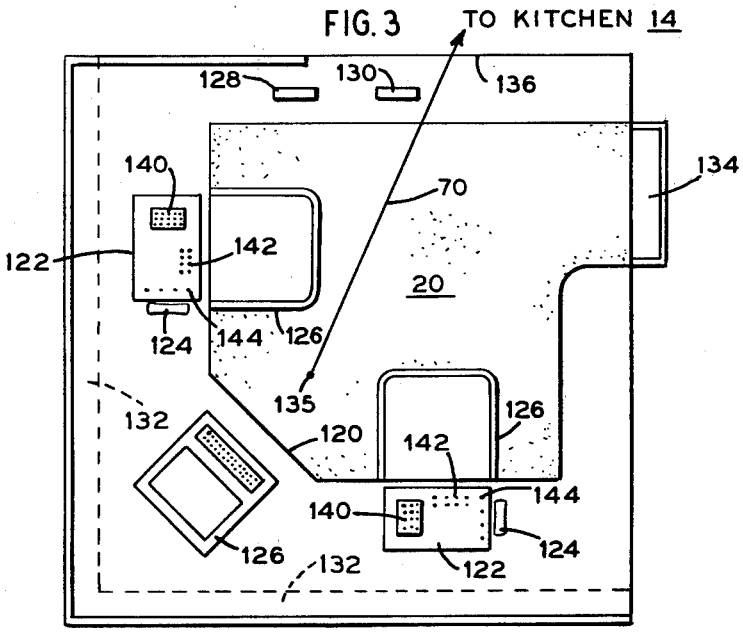
FIG. 3 is a detailed plan view of the order-taking post.
Figure 4A:
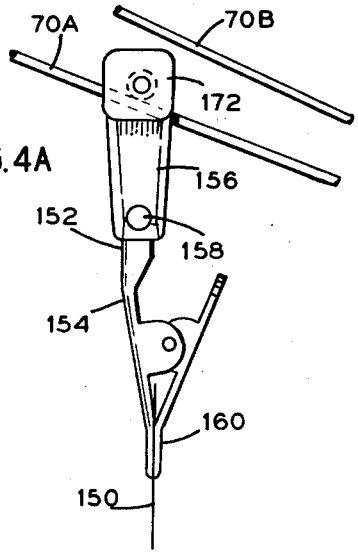
FIG. 4A is a front elevational view of a slide clip traversing the lower wire of the order conveyor showing a portion of an order card between the jaws of the slide clip.

The heart of the dining system '793 patent invention of FIG. 1, the order-taking system, is shown in greater detail in FIGS. 2–4, with the same elements bearing the same reference numbers.

The hub of the order-taking system is the order-taking post 20 (FIG. 3). It generally comprises desk counter 120, telephone switchboards 122 together with associated telephones 124, a printing calculator 126, bar order slot 128, check slot 130, pigeonhole structure 132 and ladder 134. Connected from the roof by a suitable bracket 135 is the order conveyor 70, which traverses the order-taking post 20 and, via opening 136, enters the kitchen 14 and is connected to a bracket 137 at the cooking area 54 (FIGS. 1 and 2A–2B).

Order conveyor 70 is for food check orders. Bar check orders are inserted into bar order slot 128 and pass via a slide (not shown) to the service bar adjacent the order-taking post 20 (FIG. 1).

Telephone switchboards 122 (FIG. 3) each has a Touch-Tone button panel 140, incoming-line button switches 142 and control button switches 144. Control button switches 144 permit holding calls without disconnecting, handling several calls at once, and transferring calls to another phone or to an outside line. Talking and listening "hands free" may be provided with a speakerphone. A headset may be used in place of the telephone 124.

As orders are made out, duplicate copies are stored in the pigeonhole structure 132. When a check is requested, the separate amounts for drinks, entrees, desserts, etc., are totalled on the printing calculator 126. The addition tab is then stapled to the check which is dropped in the check slot 130 and passed via a slide (now shown) to the cashier position 65 (FIG. 1). The cashier then double-checks the total and gives the final check to a passing waiter or waitress for delivery to the table requesting the check.

Orders for drinks, food, etc., are taken by order-taking persons seated in chairs 126, which are on rollers and swivel in order to provide maximum mobility. A third chair 126 may be provided for the manager or assistant manager to survey and supervise the entire restaurant.

Each check is a suitable form printed on say a five inch by eight inch card having a thickness and stiffness similar to a file card. When the order is recorded on the order card, for example, order card 150 in FIGS. 4A–4B, the card is positioned between the slidingly-gripping jaws of a slide clip 152. The slide clip 152 is then positioned between the wires 70A and 70B of the order conveyor 70, and riding on the lower wire 70A slides down into the kitchen 14 to the cooking area 54 (FIGS. 1, 2A–2B and 4A).

More particularly, slide clip 152 comprises an alligator clip 154 connected to a Teflon slide 156 via the nut-bolt connection 158. Alligator clip 154 is a standard alligator clip but with its teeth substantially flattened by inserting a steel sheet between its jaws 160 and then pressing the jaws with the sheet together in a vise. The purpose of substantially flattening the teeth is to permit the order card 150 to be pulled from between the jaws of the clip 154 by kitchen personnel without having to physically separate the jaws 160.

Slide 156 is a traverse slide normally used for supporting curtains. In the embodiment first reduced to practice and preferred, it is a traverse slide manufactured by Kirsch Co. of Sturgis, Michigan, 49091, and marketed under style number 3909-B.

wire 70A–70B in the preferred embodiment is armored polythermaleze antenna wire 14AWG Heavy with a diameter of one-sixteenth inch. In the preferred embodiment, the length of the order conveyor 70 is 174 inches with the starting position 54 inches higher than the terminal position so that the angle 170 with the horizontal is about 18 degrees (FIG. 2B). With that angle, the slide clips 152 with engaged order cards 150 slide down the order conveyor 70 at a moderate speed and with sufficient stability so that they do not fall off. The traversing speed is a function of the pull of gravity, and air and wire-slide resistance. If the angle 170 is too large, the slide clips 152 travel too fast and are unstable. If the angle 170 is too small, the slide clips 152 will not slide or will get stuck. Experiments have indicated a preferred range of angle 170 from 15 degrees to 65 degrees. Other angles may be workable depending on the parameters of the slide, friction and wire size, weight of the order card, etc.

Figure 4B:
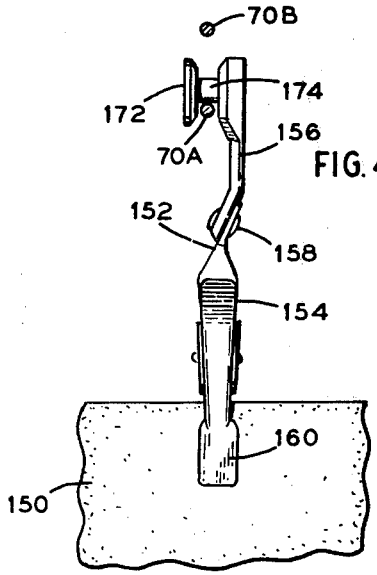
FIG. 4B is a side elevational view of the slide clip.

At the top of order conveyor 70, the wires 70A–70B are separated a distance greater than the height of the slide member 172 to permit the slide member 172 to be inserted between the wires 70A–70B and then positioned on wire 70A. Slide member 172 is connected to the main body of the slide 152 by the post 174 (FIG. 4B). The length of the post 174 is about one and one-half times the diameter of the wire 70A–70B. That spacing permits the slide clip 152 to move freely down the wire 70A.

At the lower end of the order conveyor 70, the wires 70A and 70B converge together at the mounting bracket 137 (FIG. 2B). In the preferred embodiment the inside spacing at the upper end is one inch and the inside spacing at the lower end is one-eighth inch. Since the diameter of the post 174 of the slide clip 152 is three-sixteenth inch, the upper edge of the post 174 begins to engage the lower edge of wire 70B when the spacing between wires 70A–70B converge to about three-sixteenth inch. But the momentum of the combined slide clip 152 with engaged order card 150 is such that the post 174 tends to slightly separate the wires 70A–70B so that the result is to gradually decelerate the slide clip 152 and card 150. Thus, they come to a gradual halt, increasing stability while preventing them from bouncing off the wire 70A; especially because the slide member 72 is then bridging both wires 70A–70B so that any rebound or shock does not dislodge the slide clip 152 from the order conveyor 70.

In the preferred embodiment of the invention, the order-taking post is positioned adjacent both the kitchen area and the bar area, as shown in FIG. 1. Alternatively, the order-taking post can be positioned adjacent either the kitchen area or the bar area; for example, as shown in dotted outline as the order-taking post 100 in FIG. 1. Since order-taking post 100 is positioned adjacent the bar area, it is most convenient to pass drink order checks directly to the bar area. Any food orders would have to be sent to the kitchen 14 by some mechanical conveyor means; for example, pneumatic tube. The same would be the case for an order-taking post positioned adjacent only the kitchen. In that case the drink orders would be conveyed mechanically to the bar area; for example, by pneumatic tube. In some installations, it may even be necessary or desirable to physically communicate between the order-taking post and both the kitchen and bar area over a distance, say by pneumatic tubes.

The important principle is that there be physical communication between the order-taking post and the kitchen and bar areas so that the order checks can be transported to their desired destination. But what is essential is that the order-taking post be in visual communication with people in the cocktail lounge or dining area whose orders are being taken via the telephone communication system.

TABLE TELEPHONE AND AUDIO SYSTEM (FIG. 5)

A typical table for two, table 44A, is shown in FIGS. 5 and 6B. Phone T is positioned on the dining surface of the table 44A. It is preferably of the Trimline type in order to conserve space on the table surface.

Mounted beneath the table top, on its underside surface, is speaker cabinet 200. Mounted within speaker cabinet 200 is a substantially horizontal speaker (not shown) with its speaker cone directed downwardly. A speaker volume control 202 is mounted along one side of speaker cabinet 200. Knob 204 adjusts the volume of the audio signal from the speaker.

Speaker cabinet 200 serves as a junction box for telephone cable 206 and the combined telephone audio cable 208, attached to the supporting post 212 of table 44A. Combined cable 208 is connected to the central telephone and audio system via plug 210. Plug 210 comprises the male plug 210A and the mating female plug 210B positioned near the table pedestal 214. Included in combined cable 208 is a pair of wires used to signal any cutting of the telephone cable 206, discussed in greater detail in connection with FIG. 7. Plug 210B is connected to a flat multiconductor cable 216.

In the embodiment of the system first reduced to practice, speaker cabinet 200 with speaker is of the surface mounted automotive type with a dual cone, eight ohm, three watt magnetic speaker, marketed by Radio Shack, A Tandy Corporation Company of Fort Worth, Texas 76107, Cat. No. 12-1844. The volume control 202 is an eight ohm L-Pad for controlling any eight ohm speaker volume three watts continuous-ten watts peak. The specific volume control is from Radio Shack, Cat. No. 40-980.

DETACHABLE CARPET PANELS (FIGS. 5–6)

Table 44A rests on the floor separated by carpeting 220. Carpeting 220 comprises a plurality of rectangular carpet panels 222A, 222B, etc., (FIG. 6A) arranged in an abutting rectangular pattern and attached to the concrete floor by Velcro-type connecting strips. These connecting strips consist of two parts, one being a non-woven material such as felt and the other part being of a flexible material provided with a plurality of small hook-like loops of a stiff resilient plastic material, such as nylon, projecting from the face of the material. When the two sections are pressed together, the hooks lock with the fibers of the felt, holding the two parts together. The parts can be separated by peeling one away from the other. The connection and separation may be repeated innumerable times. In a related (but patentably distinguishable) convertible floor system, rectangular carpet panels are detachably connected to Velcro-type felt strips mounted in grooves in a wooden floor in order to quickly convert a fully carpeted area into a dance floor; see U.S. Pat. No. 3,817,015 issued June 18, 1974 for a Convertible Floor System.

In the present system, a carpet panel 222 (FIG. 6A) comprises a tufted carpet section 224 with a rubber underlay 226. A recess 228 along the bottom of the outer edge of each carpet panel 222 is formed by removing a rectangular strip of rubber underlay having a width slightly larger than the width of the Velcro-type felt strip 230. Felt strip 230 is adhered to the underside of the carpet section 224 within the recess 228.

Cemented in a rectangular grid pattern 240 (FIG. 6B) to the concrete floor 242 are the matching loop strips 244. Each carpet panel 222 has a recess 228 along its outer edge on each of its four side beneath its carpet section 224. Felt strips 230 thus surround the outer edges of each carpet panel 222 below its carpet section 24. Each carpet panel 222 may thus be connected to the concrete floor 242 by connecting the felt strips 230 to the matching loop strips 244 so that each carpet panel 222 abuts an adjacent carpet panel (except for the edges of the carpet).

The depth of the rubber underlay 226 is chosen to substantially equal the depth of the connected Velcro-type strips so that there is no bulge or depression at the abutting edges of the carpet panels 222.

The rectangular grid pattern of loop strips 244 is dimensioned so that each table 44A overlays abutting carpet panel edges. This permits the flat cable 216 to pass between the concrete floor 242 and the carpet panel 222 and exit between connecting Velcro-type strips beneath the table 44A as shown in FIGS. 5 and 6A. Thus a table 44A can be moved a limited amount and its cable 216 associated with its telephone number can be moved a corresponding amount so as to exit beneath the table 44A in its new position. The Velcro-type strips are temporarily separated to permit the movement of the flat cable 216.

This feature of the system also permits the ready replacement of carpet panels 222 which are worn, damaged or soiled, or to change the decorating theme.

VARIABLY-TRANSLUCENT PARTITIONS (FIGS. 1, 8)

In the dining system 10 of FIG. 1, variably-translucent partitions 104 separate the dining area 12 from the cocktail lounge 18 and from external viewing through the windows 94. Partition 104A is mounted on the top of the back portion of banquette 42 and extends at least to a height above eye level. Partitions 104B correspond in area to the windows 94.

The partitions 104 are made of transparent acrylic plastic sheets of the Lucite or Plexiglas type. They are colorless and crystal clear with a high coefficient of light transmission and little absorption of the light passing through. They function to pipe light introduced at their edges. The light leaves the panel at frosted or roughened surfaces. Their use as partitions is not new; see U.S. Pat. No. 2,609,436 issued Sept. 2, 1952 for Partition. Also see U.S. Pat. No. 2,634,530 issued Apr. 14, 1953 for an Edge Lighted Display, which discloses the edge-lighted folded acrylic plastic sheet principle, shown in FIG. 8, which provides for uniform illumination of relatively large areas.

Partition 104 comprises a folded sheet 250 of acrylic plastic formed by bending along a median line over a straight edge while the material is in a softened condition due to heat previously applied at the fold 252. When folded the sheets are then in the form of two substantially flat superposed panels 254 and 256 joined at the fold 252. Before folding, one or both of the interior surfaces 258 and 260 is slightly roughened by sandblasting, engraving or embossing, for bleeding light.

An elongated incandescent light source 262 is mounted in base 264. A slot 266 in base 264 is adapted to receive the free ends of the panels 254 and 256, clamped by set screw 257 in close spaced parallel relation to the light source 262 so that light rays will be conducted away from the light source 262 through the panels 254 and 256. Variable voltage source 270 supplies the voltage for the light source 262. The variable voltage source 270 is preferably located at the order-taking post 20 (FIG. 1) so that the amount of light transmitted through the panels 254 and 256 can be controlled from that remote position.

By proper choice of the amount of roughening of the internal surfaces 258 and 260, the color, kind and power of the incandescent light source 262 and the amount of voltage supplied to it from the variable voltage source 270, the amount of light bled from the roughened surface can be controlled. That permits varying the visual translucency of the partition 204 from substantially transparent to substantially opaque. Moreover, the roughening can be in an artistic pattern, or visual artistic materials may be supported on the surface of or between the panels 254 and 256.

PHONE PROTECTOR SYSTEM (FIGS. 5, 7)

There is a significant risk that a patron may want to remove one of the phones T; for example, as a souvenir. In order to forestall that, a phone protector system is provided as shown in FIG. 7. An extra pair of wires 280 (FIG. 7A) is included in the phone cable 206 (FIG. 5). Comprising wires 280A and 280B, they are connected together within the phone T. Each of the pairs 280 fed to a plurality of phones T is connected in series relation with a relay 282. The series circuit includes the voltage source V and the operative coil of the relay 282 so that normally the relay 282 is in a closed position. Voltage source V also feeds the indicator 284 via a pair of normally open relay contacts.

If the telephone cable 206 is cut in an attempt to remove the phone T (FIG. 5), then relay 282 will open and indicator 284 be operated. Indicator 284 is preferably a signal light positioned at the order-taking post. A buzzer may be connected in parallel with it to give an audio indication at the same time. The order-taking person will then be alerted to scan the tables to see any suspicious activity or whether a telephone has already been removed.

The phone protector circuit of FIG. 7A does not indicate which phone cable 206 has been cut. If that is desired, then a plurality of individual series circuits can be provided as in FIG. 7B, one for each telephone T'. Corresponding parts are designated with the same reference character but with a prime designation added. A board containing an array of indicators 284', preferably located at the order-taking post 20, will then permit the identification of the severed phone cable 206.

What is claimed is:

1. A drink service system comprising:

(a) a bar area, (b) an adjacent drink service area including a plurality of tables, (c) a transparent partition substantially enclosing the bar area and separating the bar area from the adjacent drink service area to lower the level of noise transmitted from the bar area to the adjacent drink service area during busy periods of time;

(d) an electronic music source including an audio amplifier;

(e) speaker means responsive to said electronic music source and positioned within said adjacent drink service area;

(f) microphone means mounted within said enclosed bar area for sensing background noise and feeding the sensed background noise to the input of the audio amplifier of said electronic music source; and (g) noise level control means for controlling the noise audio level in the drink service area whereby the drink service area may be made to sound more busy during lull periods of time.

2. The system of claim 1 further comprising a smoke exhaust system mounted over said bar area for exhausting tobacco smoke whereby said transparent partition both encloses the bar area substantially preventing unexhausted smoke from spreading to said adjacent drink service area and lowers the level of noise transmitted from the bar area to the adjacent drink service area.

3. The drink service system of claim 1 wherein said speaker means comprises a plurality of individual speakers each mounted on one of said tables in said adjacent drink service area and table audio level control means coupled to each of the speakers for individually controlling the audio level of the combined music and noise fed from said electronic music source.

* * * * *